US005413858A

United States Patent [19]

Hajikano et al.

[11] Patent Number: 5,413,858

[45] Date of Patent: May 9, 1995

[54] ACRYLIC FIBER AND PROCESS FOR PRODUCTION THEREOF

[75] Inventors: Akira Hajikano; Seiji Hayashi; Yoshitaka Imai, all of Otake; Kunihiro Aoki, Tokyo, all of Japan

[73] Assignee: Mitsubishi Rayon Co., Ltd., Tokyo, Japan

[21] Appl. No.: 22,267

[22] Filed: Feb. 25, 1993

[30] Foreign Application Priority Data

Feb. 25, 1992 [JP] Japan ..... 4-037715
Feb. 25, 1992 [JP] Japan ..... 4-037716

[51] Int. Cl.[6] ..... D02G 3/00

[52] U.S. Cl. ..... 428/364; 428/367; 526/307.6

[58] Field of Search ..... 526/307.6; 428/364, 428/367; 264/29.2, 182, 184; 423/447.1

[56] References Cited

U.S. PATENT DOCUMENTS

| | | | |
|---|---|---|---|
| 3,720,745 | 3/1973 | Konig et al. | 526/342 |
| 3,917,776 | 11/1975 | Sato et al. | 264/182 |
| 4,002,809 | 1/1977 | Kozuka et al. | 264/182 |
| 4,017,561 | 4/1977 | Miessen et al. | 264/182 |
| 4,020,037 | 4/1977 | Hahnke et al. | 264/182 |
| 4,452,860 | 6/1984 | Obama et al. | 428/367 |
| 4,659,623 | 4/1987 | Yoshinari et al. | 428/364 |
| 4,695,415 | 8/1987 | Setsuie et al. | 264/29.2 |
| 4,869,856 | 9/1989 | Takahashi et al. | 264/29.2 |

*Primary Examiner*—N. Edwards

*Attorney, Agent, or Firm*—Oblon, Spivak, McClelland, Maier & Neustadt

[57] ABSTRACT

Acrylic fiber comprising an acrylonitrile-based copolymer comprising 96.0 to 98.5% by weight of acrylonitrile units, 1.0 to 3.5% by weight of acrylamide units and 0.5% by weight or more of methacrylic acid units, the percentage by weight (A) of acrylamide units and the percentage by weight (M) of methacrylic acid units in the copolymer satisfying the following equations (I) and (II), and adsorbed iodine in an amount of 1% by weight or less based on the weight of the copolymer:

$$X = 0.21 \text{ to } 0.23 \quad \text{(I)}$$

$$M + A^x = 1.82 \text{ to } 2.18 \quad \text{(II)}$$

A copolymer having the above-mentioned composition is spun by a wet process, while adjusting the modulus in tension of coagulated fiber to approximately 2.0–3.0 g/d, wherein d means denier in terms of the weight of polymer in the coagulated fiber. There is provided acrylic fiber which permits production of carbon fiber with a high tensile strength and a high tensile modulus by pyrolysis for a shorter time. Furthermore, there is provided a process for production, by wet spinning, of precursor fiber which does not show filament breakage for a long period of time and has only a small amount of fuzz.

1 Claim, 1 Drawing Sheet

ACRYLIC FIBER AND PROCESS FOR PRODUCTION THEREOF

BACKGROUND OF THE INVENTION

1. Field of the Invention

The present invention relates to acrylic fiber suitable for producing carbon fiber or graphite fiber, and a process for producing the acrylic fiber.

2. Description of the Prior Art

Carbon fiber and graphite fiber (hereinafter collectively referred to as "carbon fiber) which are obtained using acrylic fiber as precursor are commercially produced and sold as reinforcing fiber materials for high-performance composite materials used in the aviation industry, the aerospace industry, sports goods, leisure goods, etc., because of their excellent mechanical properties. In the market, high-quality and inexpensive carbon fiber is required for improving the performance characteristics of these composite materials.

On the composition of a copolymer as a material for acrylic fiber used as a precursor of carbon fiber (hereinafter referred to as "precursor fiber" in some cases) and a spinning process of the copolymer, a large number of proposals have been made. For example, on the composition of the copolymer, copolymers having a high content of acrylonitrile units have been proposed for improving the performance characteristics of the carbon fiber. As the spinning process, dry jet wet spinning process and wet spinning process have been proposed.

The dry jet wet spinning process entails a larger production cost than does the wet spinning process. Therefore, considering the production cost, the wet spinning process is employed. However, since fiber obtained by the wet spinning has a low denseness of structure and a large amount of fuzz, carbon fiber obtained by pyrolysis said fiber are generally not sufficient in mechanical properties and quality. In addition, the wet spinning is disadvantageous in that filament breakage in the tow often occurs during spinning.

When carbon fiber is produced by the pyrolysis of precursor fiber, the precursor fiber is subjected to oxidation in an oven and then carbonized in an inert atmosphere. Therefore, when an acrylonitrile copolymer is chosen as a material for the precursor fiber, there should be sufficiently considered not only its spinnability into fiber but also its thermochemical reaction characteristics in the oxidation and carbonizing steps and the performance characteristics of the carbon fiber.

In detail, the most suitable range of a composition of copolymer for the precursor fiber should be determined after due consideration of the facilitation of cyclization reaction, the prevention of fusing between filaments and the reduction of treatment time in the oxidation step; and the yield of the carbon fiber based on the precursor fiber, and the tensile strength, tensile modulus of elasticity and elongation of the carbon fiber after the carbonizing treatment. However, there are very few reports which quantitatively describe the composition of a suitable copolymer as an industrially valuable, general information.

Examples of information given by conventional proposals are summarized below. As an acrylonitrile copolymer for a carbon fiber precursor; a polymer having an content of acrylonitrile units of a certain value or more (about 90% by weight or more) is preferable. For passage through an oxidation step in a short time, it is effective to introduce a suitable reaction-initiating group, i.e., a functional group which accelerates the cyclic condensation reaction of a nitrile group (e.g. a carboxyl group). Under these conditions, a final composition of polymer is attained, for example, by adding other comonomers for facilitating the shaping into precursor fiber. Thus, there are a few qualitative information alone.

For example, a polymer having a high content of acrylonitrile units has a low solubility in solvents. Therefore, extremely limited processes are unavoidably employed for producing precursor fiber from the polymer, and the concentration of a spinning solution is low. Accordingly, the spinnable and shapeable properties of the polymer and the performance characteristics of carbon fiber obtained from the precursor fiber have heretofore been not satisfactory enough.

In the case of a polymer obtained by increasing the content of comonomer units for extending freedom in spinning and shaping, fusing between filaments tends to occur in pyrolysis of precursor fiber obtained from the polymer, and moreover the yield from carbonization is decreased. Thus, this polymer is still insufficient in passability through the process of pyrolysis and the quality and performance characteristics of carbon fiber.

There are very few reports which suggest the composition of a starting polymer which is free from the above various problems and permits or is advantageous for the oxidation step in a shorter time.

For example, the following methods have been proposed: a method in which the oxidation rate and the yield from carbonization are improved by employing a composition of polymer which gives a high cyclization and oxidation reactivity in the early stage of pyrotysis (Japanese Patent Application Kokoku No. 47-33019); a method in which the carbonization time is reduced in consideration of the stability in polymer production and a spinning step, by limiting a composition of polymer, for example, by employment of a vinyl carboxylate monomer (Japanese Patent Application Kokoku No. 51-7209); and a method in which an amine or a peroxide is added to a starting polymer (Japanese Patent Application Kokoku No. 51-7209 and Japanese Patent Application Kokai No. 48-87120).

However, in all of these methods, the range of the composition of polymer, i.e., the kind and content of comonomers, is wide, and it cannot be said that suitable carbonization characteristics of precursor fiber, etc. are chosen. In addition, it is considered that the acceleration of reaction in flameresisting permits high-speed carbonization, but the acceleration tends to deteriorate the performance characteristics of carbon fiber obtained by the carbonization. Thus, there have not yet been obtained a composition of polymer which is satisfactory with respect to both productivity and performance characteristics of carbon fiber. The addition of an amine or a peroxide to a polymer has various undesirable influences on the stability of a spinning solution and precursor fiber and hence is not an industrially excellent method.

In such circumstances, Japanese Patent Application Nos. 48-87120 and 52-34027 have proposed precursor fibers having a composition of polymer of an acrylonitrile/acrylamide/methacrylic acid ternary copolymer. In detail, the former discloses precursor fiber obtained from a copolymer of acrylonitrile/acrylamide/methacrylic acid in a ratio of 96/3/1 (wt %), and the latter discloses precursor fiber obtained from a copolymer of acrylonitrile/acrylamide/methacrylic acid in a ratio of 95.5/3.0/1.5 (mole %), i.e., 93.7/3.9/2.4 (wt %).

However, in the compositions of polymer of the precursor fibers disclosed in these references, the total proportion of acrylamide units and methacrylic acid units is excessive. When these precursor fibers are subjected to oxidation, the oxidation of precursor fiber proceeds rapidly in their surface portion but slowly in the inside of the filament. The thermally stabilizied fiber thus obtained has a cross section with heterogeneous structure in the radial direction of a filament in which the inside is not sufficiently oxidized. This tendency becomes marked when the oxidation is tried to be carried out in a short time. It is difficult to obtain carbon fiber with a high tensile modulus from the thermally stabilized fiber having a cross section with such a heterogeneous structure.

On the other hand, Japanese Patent Application Kokai No. 63-35821 discloses precursor fiber having a high iodine adsorption capacity, but this precursor fiber is obtained substantially from two components, i.e., acrylonitrile and itaconic acid and hence is different in comonomers from the precursor fiber of the present invention. In addition, the content of acrylonitrile units in the precursor fiber disclosed in the above reference is higher than that in the precursor fiber of the present invention, namely, it is substantially 99% by weight or more.

In the process disclosed in the above Japanese Patent Application Kokai No. 52-34027, the oxidation time is as long as 50 to 100 minutes, but carbon fiber obtained in this case has a tensile strength of 300 kg/mm$^2$ or less. Also in the process disclosed in the above Japanese Patent Application Kokai No. 48-87120, the oxidation time is as long as 40 minutes, but carbon fiber obtained in this case has a tensile strength of 400 kg/mm$^2$ or less.

Thus, although precursor fibers of an acrylonitrile/acrylamide/methacrylic acid ternary copolymer have been proposed, there has not-yet been known precursor fiber from which high-performance carbon fiber can be produced for a short oxidation time in the process of pyrolysis.

There has not yet been known a technique of producing, by wet spinning, precursor fiber which does not show filament breakage for a long period of time and has only a small amount of fuzz, by using as spinning material such a ternary copolymer as is described above.

SUMMARY OF THE INVENTION

An object of the present invention is to provide acrylic fiber which permits production of carbon fiber with a high tensile strength and a high tensile modulus by pyrolysis for a shorter time.

Another object of the present invention is to provide a process for production, by wet spinning, of precursor fiber which does not show filament breakage for a long period of time and has only a small amount of fuzz.

A gist of the present invention-consists in acrylic fiber comprising an acrylonitrile copolymer comprising 96.0 to 98.5% by weight of acrylonitrile units, 1.0 to 3.5% by weight of acrylamide units and 0.5% by weight or more of methacrylic acid units, the percentage by weight (A) of acrylamide units and the percentage by weight (M) of methacrylic acid units in the copolymer satisfying the following equations (I) and (II), and adsorbed iodine in an amount of 1% by weight or less based on the weight of the copolymer:

$$X = 0.21 \text{ to } 0.23 \quad \text{(I)}$$

$$M + A^x = 1.82 \text{ to } 2.18 \quad \text{(II)}$$

Another gist of the present invention consists in a process for producing acrylic fiber which comprises conducting wet spinning of a copolymer having the above-mentioned composition, while adjusting the tensile modulus in tension of coagulated fiber to approximately 2.0–3.0 g/d, wherein d means denier in terms of the weight of polymer in the coagulated fiber.

The precursor fiber of the present invention permits rapid oxidation, and makes it possible to reduce the production cost of carbon fiber, as compared with conventional precursor fibers. Carbon fiber obtained from the precursor fiber of the present invention has excellent quality and performance characteristics. Furthermore, according to the process for producing precursor fiber of the present invention, there can be produced, by wet spinning, precursor fiber which does not show filament breakage for a long period of time and has only a small amount of fuzz.

PREFERRED EMBODIMENTS OF THE INVENTION

Figure 1:
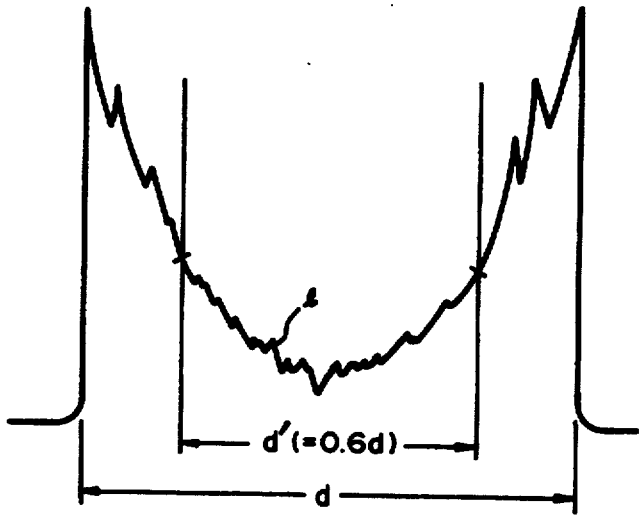
FIG. 1 is an example of secondary-electron curve diagram for measuring a surface roughness-smoothness coefficient of precursor fiber.

The copolymer which constitutes the precursor fiber of the present invention is an acrylonitrile-based copolymer having a content of acrylonitrile units of 96.0 to 98.5% by weight and a total content of acrylamide units and methacrylic acid units of 4.0 to 1.5% by weight. Thus, the contents of acrylamide units and methacrylic acid units in said copolymer are in specified ranges.

The present inventors have found that the oxidation reactivity of precursor fiber obtained from a copolymer comprising acrylonitrile units and methacrylic acid units is greatly enhanced when the copolymer further comprises a small amount (content in copolymer: about 1.0% by weight or more) of acrylamide units, and that in this case, the oxidation reactivity of the precursor fiber are very excellent when the proportions of acrylamide units and methacrylic acid units are in specified ranges. Thus, the present invention has been accomplished.

When the content of acrylonitrile units in the copolymer further comprising acrylamide units is less than 96.0% by weight, heat fusing between filaments occurs in the pyrolysis process, and hence the quality and performance characteristics of carbon fiber are deteriorated. Moreover, in this case, the heat resistance of the copolymer itself is low, so that when the copolymer is spun into precursor fiber, adhesion between filaments tends to occur in a step of, for example, drying of fiber, or drawing by means of a heating rolls. When the content of acrylonitrile units in the copolymer exceeds 98.5% by weight, the contents of acrylamide units and methacrylic acid units in the copolymer are lower than predetermined contents, as described hereinafter in detail, so that the object of the present invention cannot be achieved. Therefore, such a content of acrylonitrile units is not desirable.

When the content of acrylamide units is less than 1.0% by weight, the structure of precursor fiber obtained from the copolymer cannot become sufficiently dense (specifically, the iodine adsorption capacity is 1% by weight or less), and hence the performance characteristics of carbon fiber obtained from the precursor fiber cannot be excellent. Moreover, in the above content range, a slight change of the composition greatly affects the reactivity for oxidation and makes stable production of the carbon fiber difficult.

When the content of acrylamide units in the copolymer exceeds 3.5% by weight, the content of acrylonitrile units in the copolymer becomes too low, so that the heat resistance of the copolymer is deteriorated as described above. Therefore, such a content of acrylamide units is not desirable.

When the content of methacrylic acid units is less than 0.5% by weight, or the value in the above equation (II) is less than 1.82, the reactivity for oxidation is low and hence no high-performance carbon fiber can be obtained by the pyrolysis of the precursor fiber for a short time. When oxidation is carried out in a short time, the operation temperature is unavoidably adjusted to a high temperature, so that a vigorous incontrollable reaction is caused, resulting in problems in passability through the step and safety. On the other hand, when the value in the above equation (II) is more than 2.18, the reactivity for oxidation is enhanced, and hence in oxidation, a portion near the surface of the precursor fiber reacts rapidly, while the inside of the fiber reacts slowly. Therefore, the resulting filament has a cross section with the heterogeneous structure in the radial direction of the filament in which the inside is not sufficiently oxidized. This tendency becomes marked with a reduction of the oxidation time, resulting in rapid deterioration of the performance characteristics, in particular, tensile modulus, of carbon fiber.

Although it is sufficient that the content of methacrylic acid units is in the above range, the content is preferably as low as possible so long as a proper oxidation reactivity can be assured. This is because methacrylic acid is easily copolymerized into a main chain in the form of a block in copolymerization with acrylonitrile and hence is difficult to incorporate into a cyclic structure efficiently in a pyrolysis.

On the other hand, acrylamide is highly random-copolymerizable with acrylonitrile. Moreover, it is considered that acrylamide unit in the copolymer is formed into a cyclic structure by the pyrolysis, in a manner very similar to that for acrylonitrile. Acrylamide unit in the copolymer is hardly decomposed on heating particularly in an oxidative atmosphere, and hence acrylamide units may be contained in an amount larger than that of methacrylic acid units in the acrylonitrile copolymer.

The iodine adsorption capacity of precursor fiber of the present invention is 1% by weight or less based on the weight of the fiber.

When the iodine adsorption capacity of the precursor fiber exceeds 1% by weight, the fibrous structure loses its fineness and denseness and becomes nonuniform, resulting in formation of defective points of the fiber. Therefore, carbon fiber obtained by the pyrolysis of the precursor fiber having an iodine adsorption capacity of more than 1% by weight has a low denseness and structure defects and hence cannot exhibit excellent tensile strength and tensile modulus.

In the present specification, the term "iodine adsorption capacity" means a value measured by the following method. Two grams of precursor fiber is accurately weighed and put in a 100-ml Erlenmeyer flask. In the flask is placed 10 ml of an iodine solution which is prepared by dissolving. 100 g of pottasium iodide, 90 g of acetic acid, 10 g of 2,4-dichlorophenol and 50 g of iodine in distilled water to make a total volume of 1,000 ml, and the flask is shaken at 60° C. for 50 minutes to carry out iodine adsorption treatment. The fiber subjected to the adsorption treatment is washed with ion-exchanged water for 30 minutes and then distilled water, and subjected to centrifugal dehydration. The dehydrated fiber is placed in a 300-ml beaker, followed by adding thereto 200 ml of dimethyl sulfoxide, and the dehydrated fiber is dissolved therein at 60° C. The resulting solution is subjected to potentiometric titration with a 1/100N aqueous silver nitrate solution to determine the iodine adsorption capacity.

The precursor fiber of the present invention has a surface roughness-smoothness coefficient of preferably 2.0 to 4.0. The precursor fiber having a surface roughness-smoothness coefficient in the above range can be obtained by a wet spinning process. When the degree of unevenness of the surface is such a degree, the fusing between filaments during oxidation is suppressed, so that the passability through an oxidation step is improved. Furthermore, when carbon fiber obtained from the precursor fiber is shaped into a composite such as a prepreg, the ease of impregnation with a matrix resin into a space between carbon fibers is improved.

The term "surface roughness-smoothness coefficient" means a value measured by the following method.

In the measurement, the contrast conditions of a scanning electron microscope are adjusted using a magnetic recording tape as a standard sample. In detail, using a high-performance magnetic recording tape as a standard sample, a secondary-electron curve is allowed to reflect under the following conditions: accelerating voltage 13 kV, magnification 1,000, scanning rate 3.6 cm/sec. The contrast conditions are adjusted so that the average amplitude may be about 40 mm. After the adjustment, a primary electron is scanned in a direction perpendicular to the fiber axis of a test precursor (the direction of the fiber diameter), and a curve described by a secondary (reflected) electron thus reflected from the fiber surface is allowed to reflect on a Braun tube by means of a line profile apparatus, and gotten on a film at a magnification of 10,000. In this case, the accelerating voltage is 13 kV and the scanning rate 0.18 cm/sec.

The secondary-electron curve photograph thus obtained is twice enlarged at the time of printing, namely, the total magnification is adjusted to 20,000, whereby a second-electron curve diagram is obtained.

A typical example of the second-electron curve diagram is shown in FIG. 1. In FIG. 1, d denotes the fiber diameter, and d' denotes a region obtained by removing each of the right and left ends of the fiber diameter by 20%, i.e., the length of central portion (60%) of the fiber diameter, namely, $d'=0.6\,d$. In addition, l denotes the total length (converted to the length of a straight line) of the secondary-electron curve in the range of d'.

The surface roughness-smoothness coefficient is expressed as $l/d'$.

A process for producing the precursor fiber of the present invention is explained below. A polymerization method for preparing the acrylonitrile-based copolymer used in the present invention is not limited to any of conventional methods such as solution polymerization, slurry polymerization, etc. It is preferable to remove impurities such as unreacted monomers, polymerization catalyst residue, etc. as much as possible.

The degree of polymerization of the polymer is preferably such that the intrinsic viscosity [n] is 0.8 or more, from the viewpoint of drawing in spinning into the precursor fiber and exhibition of the performance characteristics of carbon fiber.

As a solvent used for spinning and shaping, well-known organic and inorganic solvents can be used.

Although the precursor fiber of the present invention can be produced by either wet spinning process or dry jet wet spinning process, the wet spinning process is advantageous from the viewpoint of cost.

The wet spinning process is substantially composed of steps of spinning, coagulation, drawing (in a bath, or in both air and a bath) and densification by drying.

The present inventors have found the relationship between the tensile modulus of coagulated fiber, i.e., process fiber in wet spinning, and a phenomenon which deteriorates the quality of final precursor fiber obtained by after-treatment of the coagulated fiber, such as filament breakage, fuzzing, etc. In detail, when the tensile modulus of the coagulated fiber is. approximately 2.0–3.0 g/d (d=denier in terms of the weight of polymer in the coagulated fiber), precursor fiber obtained by subjecting the coagulated fiber to after-treatment comprising drawing, washing, drying, etc. hardly shows filament breakage and has a very small amount of fuzz, and it has a stable and high quality though it is obtained by a wet spinning process.

The tensile modulus of the coagulated fiber is controlled so as to be in the above range, in view of the following. In the case where the tensile modulus is less than 2.0 g/d when for example, the composition of the copolymer, a solvent for the copolymer, the concentration of a spinning solution, a solvent/nonsolvent ratio in a coagulant, a nozzle, and the discharge rate of the spinning solution are determined in a certain manner, then increase of the solvent/nonsolvent ratio in a coagulant, increase of the concentration of the coagulating liquid, raise of the temperature of the coagulating liquid, and increase of spinning draft can be exemplified as conditions of increase of the tensile modulus. By contrast, when the tensile modulus is more than 3.0 g/d, conditions contrary to the above conditions are employed.

Suitable conditions are as follows. When a copolymer having an intrinsic viscosity [n] of approximately 1.5–2.0 is used, the copolymer concentration of the spinning solution is preferably about 15 to about 30% by weight. The coagulant consists of a mixture of a solvent and a nonsolvent for an acrylonitrile copolymer. The concentration of the solvent in the coagulant is preferably about 65 to about 75% by weight when dimethylacetamide is used as a solvent and water is used as a nonsolvent.

When the tensile modulus of the coagulated fiber is less than about 2.0 g/d, nonuniform extension is caused in the early stage of a spinning step, for example, in a coagulant, so that the fineness of denier in the resulting bunch of fibers becomes very non-uniform. Moreover, the drawability varies markedly in each step is spinning, and hence stable continuous spinning becomes difficult.

On the other hand, when the tensile modulus exceeds about 3.0 g/d, filament breakage in a coagulating bath and deterioration of the drawability in a subsequent step are caused, so that it becomes difficult to obtain precursor fiber which is satisfactory with respect to all of mechanical properties, quality and the stability of production.

When the tensile modulus of the coagulated fiber is outside the range employed in the present invention, it is difficult to obtain carbon fiber with a high strength and a high tensile modulus by the pyrolysis of precursor fiber obtained from the coagulated fiber.

In the present invention, although a drawing method is not critical, a drawing-in-bath method is usually employed.

In the drawing-in-bath method, the coagulated fiber may be directly drawn in a bath, or it may be drawn previously in air and then in a bath. The drawing in a bath is carried out at one time or in several times (two or more times) in a drawing bath usually at 50°–100° C. Water washing may be conducted before, after or during the drawing.

It is preferable to draw the coagulated fiber by a factor of about 6 or more by these operations until completion of the drawing in a bath.

The fiber thus drawn in a bath and washed can be treated with a finish and densified by drying. When the drying rate, the simpleness of facilities, fiber-densifying effect, etc. are taken into consideration, a method using a heating roller at approximately 100°–200° C. is preferable.

If necessary, the fiber may be drawn by means of a higher-temperature heating roller or pressurized steam before or after the densification by drying.

The precursor fiber thus obtained is subjected to oxidation and carbonizing treatment by a conventional method.

The present invention is specifically illustrated with the following examples, which should not be construed as limiting the scope of the invention. In the examples and the comparative examples, percents are all by weight.

(a) Composition of a copolymer:

Measured by a $_1$H-NMR method (GSX-400 type Superconducting FT-NMR mfd. by Nihon Denshi K.K.).

(b) Tensile modulus of coagulated fiber:

A bunch of coagulated fibers was collected and immediately subjected to a tensile test with Tensilon UTM-25T (mfd. by Toyo-Baldwin Co., Ltd.) in an atmosphere at a temperature of 23° C. and a humidity of 50% under conditions of a sample length (a distance between clamps) of 10 cm and a drawing rate of pulling of 10 cm/min.

As to the expression of the tensile modulus, the fineness (denier) of a bunch of coagulated fibers (d; the weight of a polymer per 9,000 m of the bunch of coagulated fibers) was calculated by the following equation, and the tensile modulus was expressed as g/d.

$$d=9{,}000\times f\times Q_p/V$$

wherein f: the number of filaments, $Q_p$: polymer discharge rate (g/min) per hole of a nozzle, V: coagulated fiber take-off rate (m/min).

(c) Intrinsic viscosity [x] of a polymer:

Measured in a dimethylformamide solution at 25° C.

(d) Strand tensile strength and tensile modulus of carbon fiber:

Measured according to JIS-7601.

EXAMPLE 1

A copolymer comprising 97.1% of acrylonitrile units, 2.0% of acrylamide units and 0.9% of methacrylic acid units and having an intrinsic viscosity [η] of 1.7 was dissolved in dimethylformamide to adjust the copolymer concentration to 23%. Thus, a spinning solution (dope) was prepared. Wet spinning was conducted by spinning the dope into an aqueous dimethylformamide solution having a concentration of 70% and a temperature of 35° C., through a nozzle having 12,000 holes. The modulus in tension of the resulting coagulated fiber was 2.3 g/d.

The coagulated fiber was washed to be freed from the solvent, while being drawn by a factor of 7, in boiling water. Thereafter, the washed fiber was immersed in a silicone-type finish and then dried with a heating roller at 140° C. to be densed, whereby precursor fiber was obtained. During the spinning procedure, broken filaments and fuzzing were hardly observed, and the stability of productivity was satisfactory. The iodine adsorption capacity of the precursor fiber was 0.8%, and its surface roughness-smoothness coefficient 3.1.

This fiber was slightly oxidized in air for 30 minutes in an oven at 230°-260° C. while being stretched by 5%, to give thermally stabilized fiber having a fiber density of 1,368 g/cm$^3$. Subsequently, the thermally stabilized fiber was heat-treated at low temperature under nitrogen for 1.5 minutes while adjusting the highest temperature and the stretching percentage to 600° C. and 5%, respectively. The fiber thus treated was further treated under nitrogen for about 1.5 minutes in a high temperature heat-treating furnace having a highest temperature of 1,400° C., while being stretched by −5%. The strand tensile strength of the carbon fiber thus obtained was 476 kg/mm$^2$, and its tensile modulus of strand 26.8 ton/mm$^2$.

When the same precursor fiber as above was subjected to the oxidation in the same oven so that the fiber density might became 1,360 g/cm$^3$ at an oxidation time of 50 minutes, and the resulting thermally stabilized fiber was carbonized under the same conditions as above, the strand tensile strength of the carbon fiber thus obtained was 480 kg/mm$^2$, and its tensile modulus of strand 27.4 ton/mm$^2$. Thus, this carbon fiber hardly possessed improved performance characteristics, indicating that as the oxidation time, 30 minutes is sufficient.

Comparative Examples 1 to 3

In the same manner as in Example 1 except for changing the coagulating bath conditions and the oxidation time to those shown in Table 1 and 50 minutes, respectively, precursor fiber was obtained and then pyrolyzed. Data on the following items obtained in this case are tabulated in Table 1: the tensile modulus of coagulated fiber, amount of fuzz and iodine adsorption capacity of the precursor fiber, and the strand characteristics of the resulting carbon fiber. When the oxidation time was 30 minutes, the resulting carbon fiber had still lower strand properties.

EXAMPLE 2

The same acrylonitrile copolymer as used in Example 1 was used. A solution of the copolymer in dimethylacetamide having a copolymer concentration of 21% was prepared as a dope. Wet spinning was conducted by spinning the dope into an aqueous dimethylacetamide solution having a concentration of 70% and a temperature of 35° C., through a nozzle having 12,000 holes.

Subsequently, the coagulated fiber thus obtained was drawn in air by a factor of 1.5, then washed to be freed from the solvent, while being drawn, in boiling water. Thereafter, the washed fiber was treated in the same manner as in Example 1 to obtain precursor fiber, which was pyrolyzed. Table 1 shows the iodine adsorption capacity of the precursor fiber, the strand characteristics of the resulting carbon fiber, etc.

Comparative Examples 4 to 8

Under the same conditions as in Example 2, except that each composition of an acrylonitrile copolymer shown in Table 2 was employed in place of that employed in Example 2, precursor fiber was obtained and then pyrolyzed. Table 2 shows the iodine adsorption capacity of the precursor fiber, the strand characteristics of the resulting carbon fiber. In Comparative Example 4, combustion and fuming took place in the oxidation step.

EXAMPLES 3 to 5

Each acrylonitrile copolymer with an intrinsic viscosity [η] of 1.7 listed in Table 1 was used. A solution of the copolymer in dimethylacetamide having a copolymer concentration of 21% was prepared as a dope. Wet spinning was conducted by spinning the dope into as aqueous dimethylacetamide solution having a concentration of 71% and a temperature of 38° C., through a nozzle having 12,000 holes.

Subsequently, the coagulated fiber thus obtained was washed to be freed from the solvent, while being drawn by a factor of 6, in boiling water. Thereafter, the washed fiber was immersed in a silicone-type finish, densed by drying with a heating roller at 140° C., and then drawn by a factor of 1.4 with a higher-temperature heating roller to obtain precursor fiber. During the spinning procedure, broken filaments and fuzzing were hardly observed, and the stability of productivity was satisfactory. Table 1 shows the tensile modulus of the coagulated fiber and the iodine adsorption capacity of the precursor fiber obtained.

The precursor fiber was pyrolyzed under the same conditions as in Example 1 to obtain carbon fiber. Table 1 shows the strand characteristics of the carbon fiber obtained.

Comparative Example 9

Precursor fiber was obtained in the same manner as in Example 5 except for changing the coagulating bath conditions to an aqueous dimethylacetamide solution having a concentration of 65% and a temperature of 38° C. In this case, the tensile modulus of coagulated fiber was 3.3 g/d, and the iodine adsorption capacity of the precursor fiber obtained 1.9%. Fiber wound around a roller used during the spinning procedure, a roller used immediately after the coagulating bath, and a roller used immediately after the drawing in hot water, and the drying roller. A large amount of fuzz and pills were observed in the precursor fiber obtained.

Under the same conditions as in Example 1, the precursor fiber was subjected to oxidation for 30 minutes and then carbonized to obtain carbon fiber. The strand characteristics of the carbon fiber obtained were as follows: tensile strength 460 kg/mm$^2$, tensile modulus 27.2 ton/mm$^2$. The carbon fiber showed a large amount of fuzz and serious filament breakage, namely, it was of low quality.

Comparative Examples 10 to 15

Spinning and pyrolysis were carried out under the same conditions as in Example 3 except for using each acrylonitrile copolymer with an intrinsic viscosity [η] of 1.7 listed in Table 3.

In Comparative Example 15, fuzzing occurred in the oxidation step, and fiber wound around the rollers frequently.

EXAMPLE 6

The copolymer with an intrinsic viscosity [η] of 1.7 listed in Table 1 was dissolved in dimethylacetamide to adjust the copolymer concentration to 23%. Thus, a dope was prepared. Wet spinning was conducted by spinning the dope into an aqueous dimethylacetamide solution having a concentration of 70% and a temperature of 35° C., through a nozzle having 2,000 holes.

The coagulated fiber thus obtained was drawn by a factor of 1.5 in air at room temperature, and then washed to be freed from the solvent, while being drawn by a factor of 4.7, in boiling water. Then, the washed fiber was immersed in a silicone-type finish solution, and densed by drying with a heating roller at 140° C. to obtain precursor fiber of 1.5 deniers. During the spinning procedure, filament breakage and fuzzing were hardly observed, and the stability of productivity was satisfactory. Subsequently, the precursor fiber was pyrolyzed under the same conditions as in Example 1.

Table 1 shows the iodine adsorption capacity of the precursor fiber, the strand characteristics of the resulting carbon fiber, etc.

Comparative Example 16

Under the same conditions as in Example 6, except that the composition of an acrylonitrile copolymer shown in Table 3 was employed in place of that employed in Example 6, precursor fiber was obtained and then pyrolyzed. Table 3 shows the iodine adsorption capacity of the precursor fiber, the strand characteristics of the resulting carbon fiber, etc.

Comparative Example 17

Under the same conditions as in Example 6, except that the composition of an acrylonitrile copolymer shown in Table 3 was employed in place of that employed in Example 6, and that the concentration of the coagulating solution was changed to 72.5%, precursor fiber was obtained and then pyrolyzed. Table 3 shows the iodine adsorption capacity of the precursor fiber, the strand characteristics of the resulting carbon fiber, etc.

TABLE 1

| | Composition of copolymer AN/AAm/MAA (wt %) | Value of $M + A^x$ (X = 0.22) | Modulus in tension of coagulated fiber (g/d) | Precursor fiber: Amount of fuzz | Precursor fiber: Iodine adsorption capacity (wt %) |
|---|---|---|---|---|---|
| Example 1 | 97.1/2.0/0.9 | 2.07 | 2.3 | Little | 0.8 |
| Example 2 | 97.1/2.0/0.9 | 2.07 | 2.3 | Little | 0.7 |
| Example 3 | 96.1/3.2/0.7 | 1.99 | 2.1 | Little | 0.9 |
| Example 4 | 97.4/1.7/0.9 | 2.02 | 2.4 | Little | 0.5 |
| Example 5 | 97.9/1.3/0.8 | 1.86 | 2.8 | Little | 0.3 |
| Example 6 | 96.5/2.7/0.8 | 2.04 | 2.3 | Little | 0.7 |
| Comparative Example 1 | 97.1/2.0/0.9 | 2.07 | 4.4 | Much | 2.5 |
| Comparative Example 2 | " | 2.07 | 1.3 | Somewhat large amount | 0.5 |
| Comparative Example 3 | " | 2.07 | 3.9 | Neither much nor little | 2.1 |

| | Oxidation time (min) | CE strand performance characteristics: Tensile strength (Kg/mm²) | CE strand performance characteristics: Tensile modulus (ton/mm²) | Coagulating conditions: Solvent | Coagulating conditions: Concentration of solvent % | Coagulating conditions: Temperature °C. |
|---|---|---|---|---|---|---|
| Example 1 | 30 | 476 | 26.8 | DMF | 70 | 35 |
| Example 2 | 30 | 470 | 26.1 | $DMA_C$ | " | 35 |
| Example 3 | 33 | 487 | 27.9 | " | 71 | 38 |
| Example 4 | 33 | 486 | 27.6 | " | " | " |
| Example 5 | 33 | 484 | 27.9 | " | " | " |
| Example 6 | 30 | 465 | 26.5 | " | | 35 |
| Comparative Example 1 | 50 | 381 | 22.6 | DMF | 60 | 35 |
| Comparative Example 2 | 50 | 316 | 22.8 | " | 73 | 35 |
| Comparative Example 3 | 50 | 420 | 23.6 | " | | 50 |

DMF: Dimethylformamide
$DMA_C$: Dimethylacetamide

TABLE 2

| | Composition of copolymer AN/AAm/MAA (wt %) | Value of $M + A^x$ (X = 0.22) | Modulus in tension of coagulated fiber (g/d) |
|---|---|---|---|
| Comparative Example 4 | 99.0/0.5/0.5 | 1.36 | 3.8 |
| Comparative Example 5 | 94.0/5.0/1.0 | 2.42 | 2.0 |
| Comparative | 97.0/1.2/2.0 | 3.00 | 2.7 |

TABLE 2-continued

| | | | |
|---|---|---|---|
| Example 6 | | | |
| Comparative Example 7 | AN/2-HEMA/MAA 97.0/2.0/1.0 | — | 3.0 |
| Comparative Example 8 | AN/DAAM/MAA 97.0/2.0/1.0 | — | 2.4 |
| Comparative Example 9 | 97.9/1.3/0.8 | 1.86 | 3.3 |

| | Precursor fiber | | Flameresisting | CE strand performance characteristics | |
|---|---|---|---|---|---|
| | Amount of fluff | Iodine adsorption capacity (wt %) | treatment time (min) | Strength ($Kg/mm^2$) | Modulus in elasticity ($T/mm^2$) |
| Comparative Example 4 | Much | 0.9 | 30 | 410 | 25.0 |
| Comparative Example 5 | Little | 1.8 | 30 | 380 | 23.3 |
| Comparative Example 6 | Little | 1.0 | 30 | 430 | 22.1 |
| Comparative Example 7 | Little | 0.8 | 30 | 425 | 24.3 |
| Comparative Example 8 | Little | 1.0 | 30 | 398 | 23.7 |
| Comparative Example 9 | Much | 1.9 | 50 | 460 | 27.2 |

Note:
AN: acrylonitrile
AAm: acrylamide
MAA: methacrylic acid
2-HEMA: 2-hydroxyethyl acrylate
DAAM: Diacetone acrylamide

TABLE 3

| | Composition of copolymer AN/AAm/MAA (wt %) | Value of $M + A^x$ ($X = 0.22$) | Modulus in tension of coagulated fiber (g/d) |
|---|---|---|---|
| Comparative Example 10 | 96.0/3.0/1.0 | 2.27 | 2.1 |
| Comparative Example 11 | 96.5/2.0/1.5 | 2.66 | 2.5 |
| Comparative Example 12 | 97.5/2.0/0.5 | 1.66 | 2.8 |
| Comparative Example 13 | 96.5/3.3/0.2 | 1.50 | 2.3 |
| Comparative Example 14 | 94.5/4.8/0.7 | 2.11 | 1.9 |
| Comparative Example 15 | 98.6/0.2/1.2 | 1.90 | 3.9 |
| Comparative Example 16 | AN/MA/MAA 95.5/3.3/1.2 | — | 4.1 |
| Comparative Example 17 | AN/MA/MAA 95.5/3.3/1.2 | — | 3.0 |

| | Precursor fiber | | Flameresisting | CE strand performance characteristics | |
|---|---|---|---|---|---|
| | Amount of fluff | Iodine adsorption capacity (wt %) | treatment time (min) | Strength ($Kg/mm^2$) | Modulus in elasticity ($T/mm^2$) |
| Comparative Example 10 | Little | 0.9 | 33 | 428 | 23.1 |
| Comparative Example 11 | Little | 0.6 | 33 | 412 | 20.0 |
| Comparative Example 12 | Little | 0.5 | 33 | 425 | 22.2 |
| Comparative Example 13 | Little | 0.6 | 33 | — | — |
| Comparative Example 14 | Somewhat large amount | 1.7 | 33 | 417 | 21.4 |
| Comparative Example 15 | Much | 1.2 | 33 | 428 | 23.2 |
| Comparative Example 16 | Much | 5.2 | 30 | 320 | 24.0 |
| Comparative Example 17 | Much | 4.1 | 30 | 275 | 23.5 |

Note:
MA: methyl acrylate

Japanese Patent Applications No. 4-37715 and No. 4-37716 are hereby incorporated herein by reference.

The present invention has been described in detail, it should be understood that various changes, substitutions and alternations can be made hereto without departing from the spirit and scope of the present invention as defined by the appended claims.

What is claimed is:

1. Acrylic fiber comprising an acrylonitrile-based copolymer comprising 96.0 to 98.5% by weight of acrylonitrile units, 1.0 to 3.5% by weight of acrylamide units and 0.5% by weight or more of methacrylic acid units, the percentage by weight (A) of acrylamide units and the percentage by weight (M) of methacrylic acid units in the copolymer satisfying the following equations (I) and (II), and adsorbed iodine in an amount of 1% by weight or less based on the weight of the copolymer:

$$X = 0.21 \text{ to } 0.23 \quad \text{(I)}$$

$$M + A^{x} = 1.82 \text{ to } 2.18 \quad \text{(II).}$$

* * * * *